US007789278B2

(12) United States Patent
Ruiz de Gopegui et al.

(10) Patent No.: US 7,789,278 B2
(45) Date of Patent: Sep. 7, 2010

(54) DUAL CHAMBER AEROSOL CONTAINER

(75) Inventors: Ricardo Ruiz de Gopegui, Dublin, CA (US); Marcus Wang, Oakland, CA (US)

(73) Assignee: The Clorox Company, Oakland, CA (US)

( * ) Notice: Subject to any disclaimer, the term of this patent is extended or adjusted under 35 U.S.C. 154(b) by 813 days.

(21) Appl. No.: 11/734,364

(22) Filed: Apr. 12, 2007

(65) Prior Publication Data

US 2008/0251547 A1 Oct. 16, 2008

(51) Int. Cl.
*B65D 83/14* (2006.01)

(52) U.S. Cl. ..... 222/635; 222/136; 222/145.5; 222/182; 222/399; 222/402.13; 222/402.18; 239/303; 239/308

(58) Field of Classification Search ..... 222/635, 222/1, 136, 145.1, 145.5, 145.6, 399, 402.1, 222/402.22, 402.23, 402.18, 94–95, 325, 222/182, 402.13; 239/337, 340, 303–304, 239/306, 308
See application file for complete search history.

(56) References Cited

U.S. PATENT DOCUMENTS 3,289,949 A * 12/1966 Roth ..... 239/579
3,388,838 A * 6/1968 Marchant ..... 222/635
3,389,837 A 6/1968 Marand
3,401,844 A 9/1968 Hanson, Jr.
3,409,180 A * 11/1968 Schenk ..... 222/635
3,420,415 A * 1/1969 Kuffer ..... 222/635
3,451,596 A 6/1969 Marand
3,653,547 A * 4/1972 Marraffino ..... 222/94
3,894,659 A 7/1975 Focht
4,308,973 A 1/1982 Irland
4,431,119 A * 2/1984 Stoody ..... 222/129
4,441,632 A 4/1984 Stoody
4,909,420 A 3/1990 Reyner
4,988,017 A 1/1991 Schrader et al.
5,022,564 A 6/1991 Reyner
5,080,826 A 1/1992 Colborn et al.
5,086,266 A * 2/1992 Shiga et al. ..... 322/28
5,111,971 A 5/1992 Winer (Continued)

FOREIGN PATENT DOCUMENTS

WO WO2004/069667 8/2004

*Primary Examiner*—Frederick C. Nicolas
(74) *Attorney, Agent, or Firm*—David Peterson

(57) ABSTRACT

An aerosol spray dispenser is disclosed that includes an outer housing that is circular, oval, or non-oval and in which an active composition to be dispensed is provided and a closure sleeve housing within the outer housing. An inner receptacle is provided within the closure sleeve housing and within the volume of the outer housing and contains a propellant to be dispensed. The inner housing may be concentrically located within the outer housing. An actuator assembly houses a nozzle that has a venturi constriction. A tube extends within the outer housing to provide the passage of active composition from within the outer housing by the venturi effect. A conduit for the passage of a propellant from the inner receptacle to the nozzle is provided. The propellant and the active composition are mixed and dispensed as a spray at a nozzle by action of the venturi effect. Materials that are not compatible with the active composition can be added to the propellant and effectively mixed and dispensed, for example a fragrance that is incompatible with hypochlorite or one component or a two part hardening composition.

13 Claims, 5 Drawing Sheets

U.S. PATENT DOCUMENTS

| | | | |
|---|---|---|---|
| 5,152,411 | A | 10/1992 | Pope et al. |
| 5,183,185 | A | 2/1993 | Hutcheson et al. |
| 5,232,126 | A | 8/1993 | Winer |
| 5,263,519 | A | 11/1993 | Reyner |
| 5,281,280 | A | 1/1994 | Lisowski et al. |
| 5,507,420 | A | 4/1996 | O'Neill |
| 5,553,753 | A | 9/1996 | Abplanalp |
| 5,579,944 | A | 12/1996 | Hafner et al. |
| 5,716,007 | A | 2/1998 | Nottingham et al. |
| 5,730,326 | A | 3/1998 | Kaeser |
| 5,730,335 | A | 3/1998 | Maas et al. |
| 6,019,252 | A | 2/2000 | Benecke et al. |
| 6,092,697 | A | 7/2000 | Weaver et al. |
| 6,126,810 | A | 10/2000 | Fricker et al. |
| 6,196,275 | B1 | 3/2001 | Yazawa |
| 6,296,744 | B1 | 10/2001 | Djeiranishvili et al. |
| 6,364,172 | B1 | 4/2002 | Maas et al. |
| 6,394,364 | B1 | 5/2002 | Abplanalp |
| 6,426,066 | B1 | 7/2002 | Najafi et al. |
| 6,474,513 | B2 | 11/2002 | Burt |
| 6,481,435 | B2 | 11/2002 | Hochrainer et al. |
| 6,502,766 | B1 | 1/2003 | Streutker et al. |
| 6,586,063 | B1 | 7/2003 | Albanesi et al. |
| 6,589,509 | B2 | 7/2003 | Keller et al. |
| 6,623,695 | B2 | 9/2003 | Malchesky et al. |
| 6,632,347 | B1 | 10/2003 | Buckley et al. |
| 6,651,650 | B1 | 11/2003 | Yamamoto et al. |
| 6,708,852 | B2 | 3/2004 | Blake |
| 6,817,493 | B1 | 11/2004 | Parsons et al. |
| 7,147,172 | B2 * | 12/2006 | Darling et al. ..... 239/302 |
| 2002/0179884 | A1 | 12/2002 | Hoshino et al. |
| 2002/0182262 | A1 | 12/2002 | Selkon |
| 2003/0052194 | A1 | 3/2003 | Streutker et al. |
| 2003/0102328 | A1 | 6/2003 | Abplanalp et al. |
| 2003/0178432 | A1 | 9/2003 | Meiland et al. |
| 2003/0185704 | A1 | 10/2003 | Bernard et al. |
| 2003/0186827 | A1 | 10/2003 | Makansi |
| 2003/0216271 | A1 | 11/2003 | Scheper et al. |
| 2004/0042974 | A1 | 3/2004 | Dupuis et al. |
| 2004/0256482 | A1 | 12/2004 | Linden |
| 2005/0035213 | A1 | 2/2005 | Erickson et al. |

* cited by examiner

10

DUAL CHAMBER AEROSOL CONTAINER

BACKGROUND OF THE INVENTION

1. Field of the Invention

The present invention relates to an aerosol spray bottle having an ergonomic design for dispensing an active composition or mixtures.

2. Description of the Related Art

Aerosol sprayers have some form of lever or button typically operated by the finger or hand of the user, to dispense an active composition and propellant from the container. The active composition can be in the form of a spray, stream, or foam. Most aerosol sprayers have one chamber containing both the propellant and the active composition. Some aerosol sprayers dispense the propellant and the active composition from separate containers. In this case, the actual mixing of the propellant and active composition occurs at different locations relative to the output nozzle depending upon the dispenser design. It is most advantageous to create the mixing right at or before the nozzle. For example, the propellant and active composition when mixed may have a short shelf life after mixing. Another example where mixing just prior to spraying is important is the situation where the propellant and active composition immediately start to separate after mixing.

Some aerosol sprayers use the venturi effect to withdraw the active composition. Two chambers are used, one containing a propellant and the other the active composition. In one example, the propellant chamber is on top of the chamber containing the active composition. The Preval® Sprayer from Precision Valve Corporation can be attached on top of a container with a standard fitment. In this sprayer, the propellant in the propellant chamber pulls the liquid active composition up through a dip tube running through the middle of the propellant chamber and out the aerosol valve using the venturi effect. This is convenient because of its versatility in attachment and has found commercial use, but it is not ergonomically designed for consumers because of its tall design.

U.S. Pat. No. 6,394,364 describes a dual receptacle aerosol sprayer which works on a similar principle, except that the propellant chamber has been pushed down into the chamber containing the active composition. The outer chamber containing the active composition surrounds and is in contact with the inner chamber containing the propellant. A product conduit or dip tube extends from, and passes through, the bottom of the inner chamber. The propellant draws the product out the nozzle by the venturi effect. When the aerosol actuator is depressed the venturi constriction draws product from the outer chamber up into the product conduit and into an aerosol valve housing where it is valved into an actuator, where the product and propellant mix and are dispensed through the discharge outlet. To prevent misdirected propellant on clogging of the actuator, the sprayer requires a complicated design of valving including a primary propellant valve, a secondary product valve, and a tertiary valve downstream of the secondary product valve. This design is more ergonomic, however, it still suffers from the fact that the dip tube runs through the middle of the propellant chamber.

U.S. Pat. No. 3,451,596 describes a dual receptacle aerosol sprayer which has a dip tube which is exterior to the propellant chamber. However, the inner propellant chamber is still in contact with the active composition within the outer chamber. The active composition may be corrosive and because the propellant chamber is under pressure and frequently made of metal, it is susceptible to pinhole leaks from corrosion. The designs from both U.S. Pat. No. 6,394,364 and U.S. Pat. No. 3,451,591 do not solve this problem and additionally they do not have the consumer convenience of the Preval® attachment mechanism. This invention is designed to overcome the problems encountered in the prior art.

BRIEF SUMMARY OF THE INVENTION

The present invention provides an aerosol spray dispenser and method of operation that provides excellent mixing and dispensing of propellant and active compositions that are not compatible with each other. Additionally, the propellant chamber can contain a second active composition that is incompatible with the first active composition. The present aerosol dispenser is simple in design and economical to manufacture. The present aerosol dispenser can isolate the propellant chamber from the active composition chamber with a closure sleeve housing and can be used in a refillable or cartridge fashion where the separate component chambers are easily connected or replaced.

The aerosol dispenser of the present invention includes an outer housing or container in which an active composition to be dispensed is provided. An inner housing within the volume of the outer housing contains a propellant receptacle containing propellant to be dispensed. In a suitable embodiment the inner housing is concentrically located within the outer housing. In another suitable embodiment the inner housing is not concentrically located within the outer housing. This is possible when the outer housing in not concentric. In a suitable embodiment, the propellant is contained within the inner receptacle that fits within a closure sleeve housing or container. A tube extends within the outer housing to provide the passage of active composition from within the outer housing, but not through the propellant receptacle, and out the actuator discharge outlet by means of the venturi effect caused by the flow of propellant separately connected to the actuator.

An over-cap assembly encloses the outer housing and has a manual actuator. In a suitable embodiment the manual actuator is a resilient member formed as an integral part of the over-cap. A key-shaped slit is made to form a "button". The slit is formed so that one section remains attached to the remainder of the over-cap in a cantilevered fashion allowing flexing of the button.

An actuator assembly houses a nozzle that has a venturi constriction. It includes a propellant conduit for the passage of a propellant from the inner receptacle to the nozzle. It also has an active composition conduit extending from the outlet end of the tube that extends into the outer housing to the nozzle. The actuator assembly further has a responder that is engaged by the manual actuator allowing the propellant to pass through the propellant conduit and allowing the active composition to pass through the active composition conduit, both to the nozzle, where the propellant and the active composition are mixed and dispensed as a spray by action of the venturi effect. In the suitable embodiment the outer and inner housings can be cylindrically shaped and/or can be arranged concentrically with respect to each other.

The aerosol dispenser of the present invention can be used to disperse a variety of compositions from within the outer housing. One example is a concentrated or dilute solution of hypochlorite or other oxidant. Hypochlorite generally is not compatible with many other chemicals, including surfactants and fragrances. Such chemicals can be provided as a mixture with the propellant. The propellant can also contain other chemicals that are generally non-compatible with hypochlorite such as buffers, anti-allergen compounds, other air disinfectants and deodorizing compounds. Since the compositions are mixed just prior to use, the effects of this incompatibility can be minimized.

DETAILED DESCRIPTION OF THE INVENTION

Figure 1:
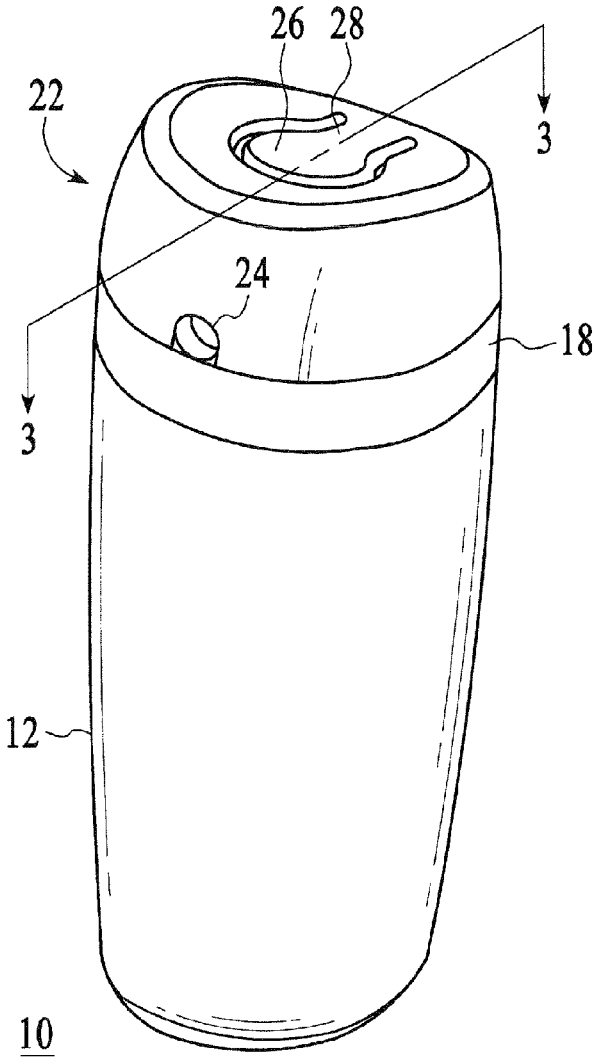
FIG. 1 is a prospective view of an embodiment of an aerosol dispenser in accordance with the invention.
Figure 2:
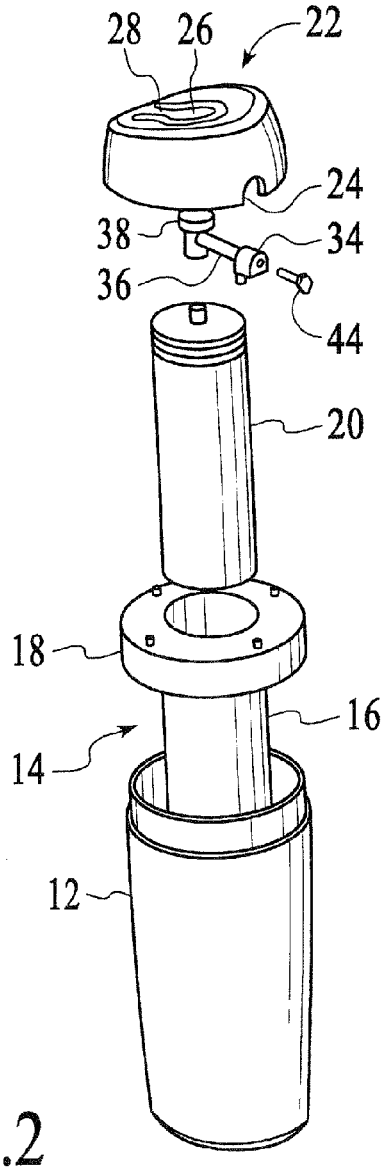
FIG. 2 is an exploded view of major assemblies of the aerosol dispenser of FIG. 1.

FIGS. 1 and 2 illustrate the major components of an embodiment of an aerosol dispenser 10 in accordance with the present invention. An outer housing 12 has a bottle or can-shaped configuration. Arranged concentrically within the outer housing is an inner housing or sleeve 14, which has a propellant receptacle containing portion 16 as will be described subsequently. Inner housing 14 also has formed therein a closure cap 18, which encloses and seals the outer housing 12. An aerosol container or receptacle 20 fits within the portion 16 of the inner housing 14.

Affixed to the closure cap 18 is an overcap assembly 22 that has an opening 24 through which mixed compositions in the form of a spray are dispensed. Formed in the overcap assembly 22 is a manual actuator or button 26 that is formed by cutting a keyhole shaped slit 28 in the top of the cap 18.

Figure 3:
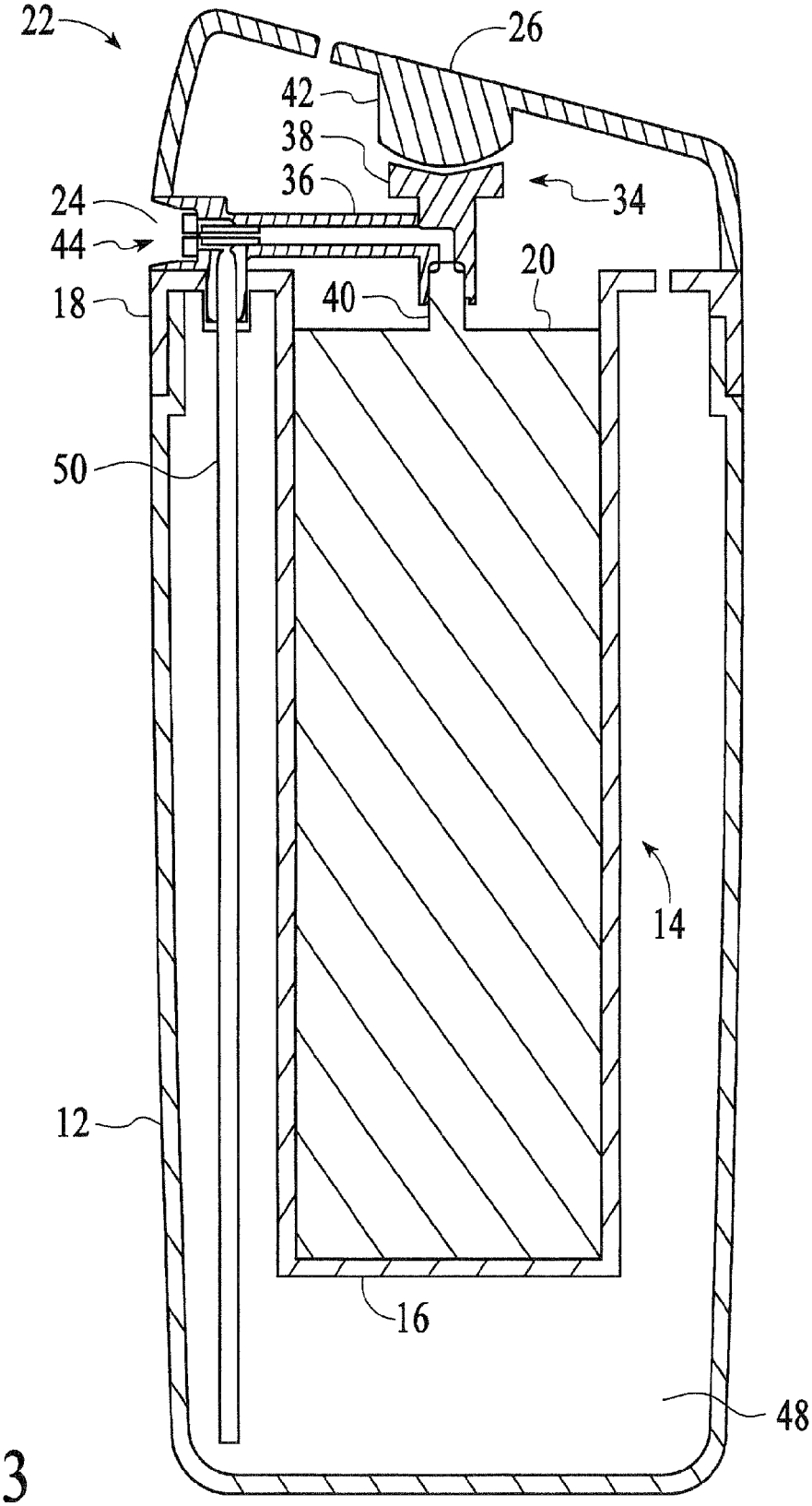
FIG. 3 is a sectional view of the aerosol dispenser taken along the lines indicated in FIG. 1.
Figure 4:
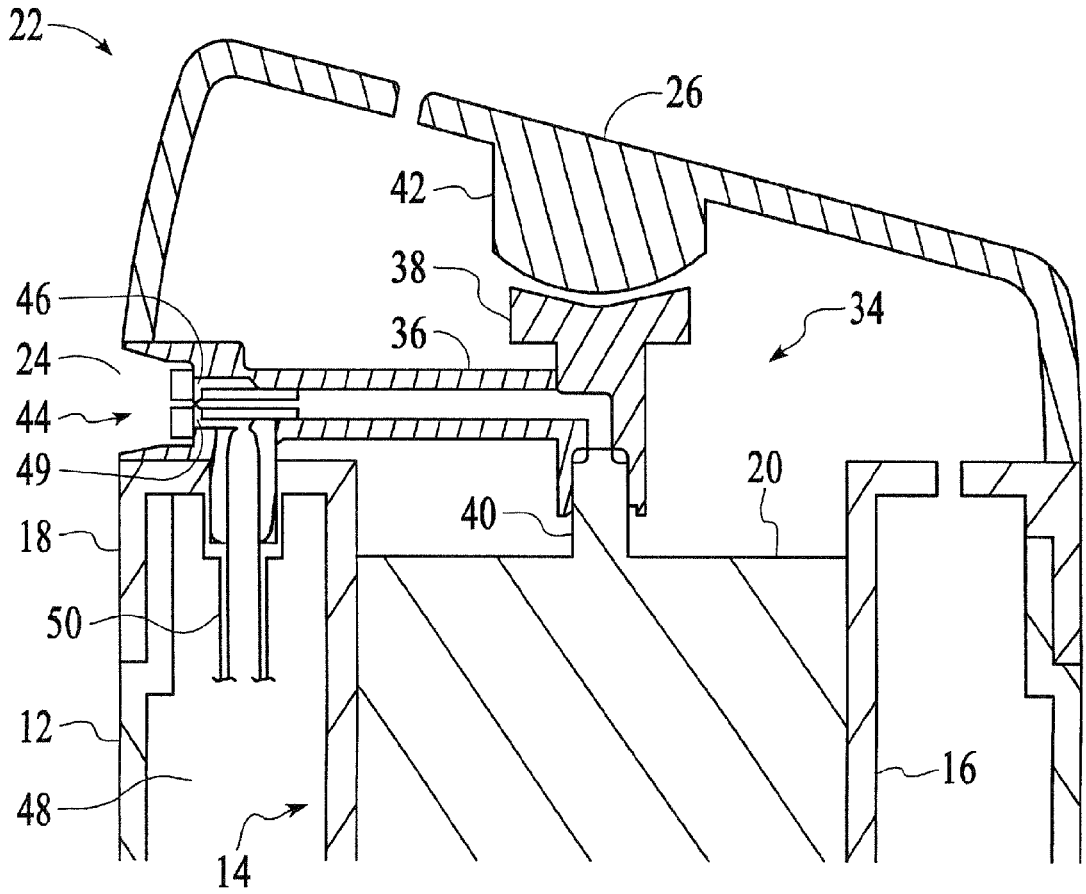
FIG. 4 is an expanded view of the actuator portion of the aerosol dispenser of FIG. 3.

Referring additionally to FIGS. 3 and 4, actuator assembly 34 has a conduit 36 that passes through a responder portion 38 and engages an outlet 40, containing a valve (not shown), from propellant receptacle 20. When the dispenser is to be activated, responder 38 is engaged by a protrusion 42 formed under the button 26 in the overcap assembly 22. When the user presses down on button 26, protrusion 42 engages responder portion 38 which opens the valve (not shown) to allow propellant to pass out of receptacle 20 and through conduit 36.

A conventional nozzle 44 fits in the dispensing end of conduit 36. Nozzle 44 has a venturi constriction 46 best seen in FIG. 4. An active composition to be dispensed fills the volume 48 between the walls of the outer receptacle 12 and the inner receptacle 14. The distal end of a tube 50 extends near the bottom of volume 48. The other end fits within a concentrically shaped conduit or manifold 49. When the aerosol dispenser is activated and propellant passes out through the venturi constriction in the nozzle 44, active composition is drawn out through tube 50 to the venturi restriction where the active composition is mixed with the propellant and dispersed as a spray through opening 24.

Aerosol dispenser 10 using the venturi effect is capable of producing a fine mist not available in other aerosol designs or trigger sprays not using the venturi design. The present invention can be used to disperse a variety of solutions from within the outer housing. One such example is a dilute solution of hypochlorite that is not compatible with other chemicals such as surfactants and fragrances that can be provided with the propellant within the receptacle 20. The propellant can be a compressed gas, such as nitrogen, or a liquefied gas, such as a hydrocarbon. The propellant chamber can also contain other chemicals that are generally non-compatible with hypochlorite or other active composition such as buffers, anti-allergen compounds, other air disinfectants and deodorizing compounds. Surfactants include anionic, nonionic, cationic and/or amphoteric agents that reduce surface tension when dissolved in water. Fragrances include limonene and complex mixtures of fragrance agents. Buffers include pH adjusting agents, such as sodium hydroxide, sodium carbonate, citric acid, and EDTA. Anti-allergen compounds include metallic agents, such as stannic compounds, and other agents, such as boric acid. Air disinfectants include agents such as hydrogen peroxide and essential oils. Deodorizing compounds include agents that mask odors, such as smoke or cooking odors.

Other compositions that can be dispersed include herbicides, insecticides, cosmetics and other household products. A further application is two part hardening composition, such as an epoxy glue, where just before the application of the glue, the two-epoxy components are mixed together, and then the mixture is expelled to achieve the glue effect.

In a suitable embodiment the outer housing 12, the inner housing 14, and/or the overcap 22 are made of plastic, including polyolefins such as polyethylene (PE) or polypropylene (PP) as well as polyesters such as polyethylene terephthalate (PET), nylons, polycarbonates, polyvinylchloride (PVC), and copolymer PVC. Since these components are not used to store propellant, they are not required to withstand high pressures. While the shapes of the inner and outer housing in the described embodiment are generally cylindrical, other shapes may be employed, such as a tapered waist design, FIG. 5, or octagonal or other multifaceted shapes.

Figure 5:
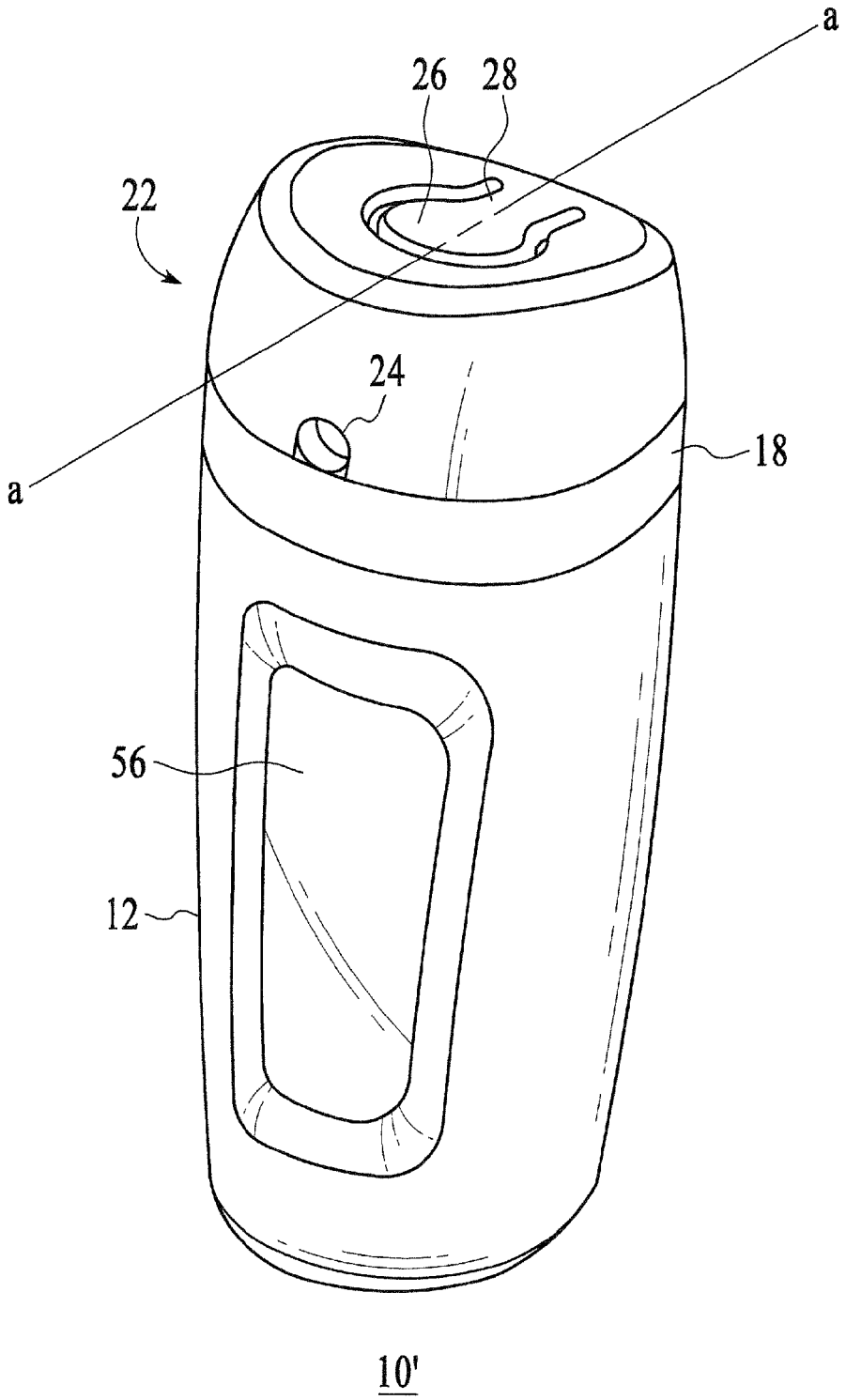
FIG. 5 is a prospective view of another embodiment of an aerosol dispenser in accordance with the invention.

FIG. 5 shows an aerosol spray dispenser 10 having an indented area 56 that creates a tapered waist. In FIG. 5 the indented area is shown perpendicular to axis a-a. A second indented area (not shown) may be formed on the back of the outer housing perpendicular to the axis a-a. The indented area may also be in the two planes of the outer housing 12 that are parallel with the axis a-a.

Figure 6:
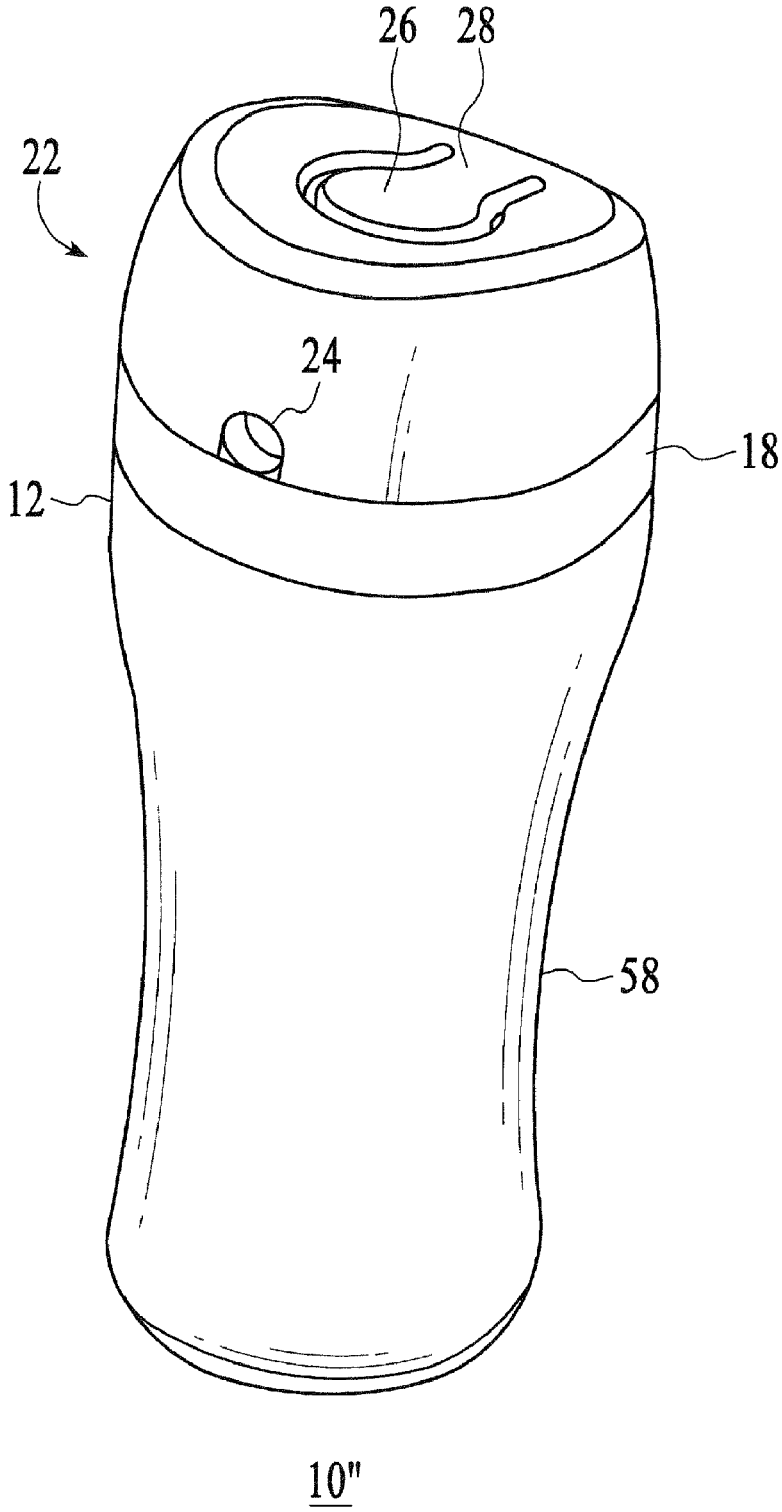
FIG. 6 is a prospective view of yet another embodiment of an aerosol dispenser in accordance with the invention.

FIG. 6 shows an aerosol spray dispenser 10 which has a contoured outer housing 12 which defines a waist 58 which extends completely around the dispenser 10.

The aerosol spray dispenser of the present invention has significant advantages. It is simple and easily manufactured. The tube that delivers the active composition is attached at its delivery end right at the nozzle and does not pass through the propellant receptacle. As a result the propellant receptacle is simple in design and fits within the inner housing with its outlet directly in communication with the actuator assembly.

The present invention is not limited to the embodiments described above herein, which may be amended or modified without departing from the scope of the present invention as set forth in the appended claims, and structural and functional equivalents thereof.

In methods that may be performed according to preferred embodiments herein and that may have been described above and/or claimed below, the operations have been described in selected typographical sequences. However, the sequences have been selected and so ordered for typographical convenience and are not intended to imply any particular order for performing the operations.

In addition, all references cited above herein, in addition to the background and summary of the invention sections themselves, are hereby incorporated by reference into the detailed description of the preferred embodiments as disclosing alternative embodiments and components.

What is claimed is:

1. An aerosol spray dispenser comprising, an outer housing defining a volume and containing an active composition to be dispensed, an inner housing within the volume of the outer housing and containing a propellant receptacle containing a propellant to be dispensed, a nozzle having a venturi restriction, a tube having a first end extending into the outer housing and having a second end, an over-cap enclosing the outer housing and having a manual actuator, an actuator assembly which houses the nozzle and includes a propellant conduit for the passage of the propellant from the propellant receptacle within the inner housing to the nozzle, an active composition conduit extending from the second end of the tube to the nozzle, and a responder which is engaged by the manual actuator allowing the propellant to pass through the propellant conduit and allowing the active composition to pass through the active composition conduit, both to the nozzle, where the propellant and the active composition are mixed and dispensed.

2. The aerosol spray dispenser of claim 1 wherein the outer housing is cylindrically-shaped.

3. The aerosol spray dispenser of claim 1 wherein the outer housing is not cylindrically-shaped.

4. The aerosol spray dispenser of claim 1 wherein the outer housing is made of plastic.

5. The aerosol spray dispenser of claim 1 wherein the inner housing is cylindrically-shaped.

6. The aerosol spray dispenser of claim 1 wherein the inner housing is made of plastic.

7. The aerosol spray dispenser of claim 1 wherein the inner housing is generally concentrically positioned relative to the outer housing.

8. The aerosol spray dispenser of claim 1 wherein the manual actuator is a resilient member formed as an integral part of the over-cap.

9. The aerosol spray dispenser of claim 1 wherein the propellant receptacle additionally contains a material that is non-compatible with the active composition.

10. The aerosol spray dispenser of claim 9 wherein the non-compatible material is selected from the group consisting of surfactants, buffers, fragrances, antiallergenic compounds, air disinfectants, deodorizing compounds, and combinations thereof.

11. The aerosol spray dispenser of claim 1 wherein the active composition comprises hypochlorite.

12. The aerosol spray dispenser of claim 9 wherein the active composition comprises hypochlorite.

13. The aerosol spray dispenser of claim 1 wherein the active composition is one of the two components of a two part hardening composition and wherein the propellant includes the other of the two components.

* * * * *